US009108440B2

(12) United States Patent
De Meutter et al.

(10) Patent No.: US 9,108,440 B2
(45) Date of Patent: Aug. 18, 2015

(54) APPARATUS AND METHOD FOR SINGLE PASS INKJET PRINTING

(71) Applicant: AGFA GRAPHICS NV, Mortsel (BE)

(72) Inventors: Stefaan De Meutter, Mortsel (BE); David Tilemans, Mortsel (BE); Peter Bracke, Mortsel (BE)

(73) Assignee: Agfa Graphics NV, Mortsel (BE)

( * ) Notice: Subject to any disclaimer, the term of this patent is extended or adjusted under 35 U.S.C. 154(b) by 0 days.

(21) Appl. No.: 14/378,980

(22) PCT Filed: Feb. 28, 2013

(86) PCT No.: PCT/EP2013/053984

§ 371 (c)(1),
(2) Date: Aug. 15, 2014

(87) PCT Pub. No.: WO2013/127889

PCT Pub. Date: Sep. 6, 2013

(65) Prior Publication Data

US 2015/0035905 A1 Feb. 5, 2015

Related U.S. Application Data

(60) Provisional application No. 61/609,958, filed on Mar. 13, 2012.

(30) Foreign Application Priority Data

Mar. 2, 2012 (EP) ..... 12157840

(51) Int. Cl.

| | |
|---|---|
| ***B41J 2/01*** | (2006.01) |
| ***B41J 11/00*** | (2006.01) |
| ***B41J 2/21*** | (2006.01) |
| ***B41M 7/00*** | (2006.01) |
| ***B41J 2/145*** | (2006.01) |

(52) U.S. Cl.
CPC ..... *B41J 11/002* (2013.01); *B41J 2/145* (2013.01); *B41J 2/2146* (2013.01); *B41M 7/0081* (2013.01)

(58) Field of Classification Search
CPC .... B41J 11/002; B41J 11/0015; B41J 2/2114; B41M 5/0047; B41M 5/0011; B41M 7/00
See application file for complete search history.

(56) References Cited

U.S. PATENT DOCUMENTS

2002/0163557 A1* 11/2002 Du et al. ..... 347/43
2007/0139504 A1 6/2007 Siegel

FOREIGN PATENT DOCUMENTS

EP 1 199 181 A2 4/2002
EP 1 645 605 A1 4/2006

(Continued)

OTHER PUBLICATIONS

Official Communication issued in International Patent Application No. PCT/EP2013/053984, mailed on Apr. 3, 2013, 2013.

*Primary Examiner* — Lamson Nguyen
(74) *Attorney, Agent, or Firm* — Keating & Bennett, LLP

(57) ABSTRACT

A method and an inkjet printing device for single pass printing on an ink-receiver having a surface includes a plurality of sets of nozzles for jetting N inks on the surface, wherein N is larger than or equal to one, the N inks including a first ink, and wherein the plurality of sets of nozzles includes a first and a second set of nozzles for jetting the first ink; the device further including a radiation curing device arranged to cure the first ink when jetted on the surface by the first set of nozzles, wherein the radiation curing device is positioned between the first set of nozzles and the second set of nozzles.

15 Claims, 2 Drawing Sheets

(56) References Cited

FOREIGN PATENT DOCUMENTS

| | | | |
|---|---|---|---|
| EP | 1 930 169 | A1 | 6/2008 |
| EP | 1 967 375 | A2 | 9/2008 |
| EP | 2 053 104 | A1 | 4/2009 |
| EP | 2 335 940 | A1 | 6/2011 |
| WO | 03/074619 | A1 | 9/2003 |
| WO | 2004/002746 | A1 | 1/2004 |
| WO | 2006/125780 | A1 | 11/2006 |
| WO | 2009/017477 | A1 | 2/2009 |

* cited by examiner

APPARATUS AND METHOD FOR SINGLE PASS INKJET PRINTING

CROSS-REFERENCE TO RELATED APPLICATIONS

This application is a 371 National Stage Application of PCT/EP2013/053984, filed Feb. 28, 2013. This application claims the benefit of U.S. Provisional Application No. 61/609,958, filed Mar. 13, 2012, which is incorporated by reference herein in its entirety. In addition, this application claims the benefit of European Application No. 12157840.5, filed Mar. 2, 2012, which is also incorporated by reference herein in its entirety.

BACKGROUND OF THE INVENTION

1. Field of the Invention

The present invention relates to high speed single pass inkjet printing devices and methods exhibiting high image quality.

2. Description of the Related Art

In inkjet printing, tiny drops of ink fluid are projected directly onto an ink-receiver surface without physical contact between the printing device and the ink-receiver. The printing device stores the printing data electronically and controls a mechanism for ejecting the drops image-wise. Printing is accomplished by moving a print head relative to the ink-receiver, i.e. the print head is moved across the ink-receiver or vice versa or both. The print head has nozzles from which the drops are ejected.

In a single pass printing process, usually the ink-jet print heads cover the whole width of the ink-receiver and can thus remain stationary while the ink-receiver surface is transported under the ink-jet printing heads. This allows for high speed printing if good image quality is attainable on a wide variety of ink receivers.

The composition of the inkjet ink is dependent on the inkjet printing method used and on the nature of the ink-receiver to be printed. UV-curable inks are more suitable for non-absorbent ink-receivers than e.g. water or solvent based inkjet inks. However the behaviour and interaction of a UV-curable ink on a substantially non-absorbing ink-receiver was found to be quite complicated compared to water or solvent based inks on absorbent ink-receivers. In particular, a good and controlled spreading of the ink on a non-absorbing ink receiver with a low surface energy is problematic.

EP 1199181 A (TOYO INK) discloses a method for ink-jet printing on a surface of a synthetic resin substrate comprising the steps of:

1. conducting a surface treatment to the surface so as to provide the surface with a specific surface free energy of 65-72 mJ/m$^2$
2. providing an activation energy beam curable ink having a surface tension of 25-40 mN/m
3. discharging the ink onto the surface having the specific surface free energy with an ink-jet printing device thereby forming printed portions of the ink on the surface and
4. projecting an activation energy beam onto the printed portions.

The method of EP 1199181 A (TOYO INK) appears to teach that the surface energy of the ink-receiver surface should be greater than the surface energy of the ink. Yet in the examples, although the surface energy of the four untreated synthetic resin substrates (ABS, PBT, PE and PS) was higher than the surface energy of the four different inks, a good "quality of image" i.e. good spreading of the ink was not observed. The surface treatments used in the examples to increase the surface free energy of the ink receiver were corona treatments and plasma treatments. Since the life-time of such surface treatments is rather limited, it is best to incorporate the surface treatment equipment into the inkjet printer which makes the printer more complex and expensive.

EP 2053104 A (AGFA GRAPHICS) discloses a radiation curable inkjet printing method for producing printed plastic bags using a single pass inkjet printer wherein a primed polymeric substrate has a surface energy $S_{sub}$ which is at least 4 mN/m smaller than the surface tension $S_{Liq}$ of the non-aqueous radiation curable inkjet liquid.

In general, the surface tension used to characterize an inkjet ink is its "static" surface tension. However, inkjet printing is a dynamic process wherein the surface tension changes dramatically over a time scale measured in tens of milliseconds. Surface active molecules diffuse to and orient themselves on newly formed surfaces at different speeds. Depending on the type of molecule and surrounding medium, they reduce the surface tension at different rates. Such newly formed surfaces include not only the surface of the ink droplet leaving the nozzle of a print head, but also the surface of the ink droplet landing on the ink receiver. The maximum bubble pressure tensiometry is the only technique that allows measurements of dynamic surface tensions of surfactant solutions in the short time range down to milliseconds. A traditional ring or plate tensiometer cannot measure these fast changes.

EP 1645605 A (TETENAL) discloses a radiation-hardenable inkjet ink wherein the dynamic surface tension within the first second has to drop at least 4 mN/m in order to improve the adhesion on a wide variety of substrates. According to paragraph [0026], the dynamic surface tension of the ink measured by maximum bubble pressure tensiometry was 37 mN/m at a surface age of 10 ms and 30 mN/m at a surface age of 1000 ms.

Spreading of a UV curable inkjet ink on an ink receiver can further be controlled by a partial curing or "pin curing" treatment wherein the ink droplet is "pinned", i.e. immobilized and no further spreading occurs. For example, WO 2004/002746 (INCA) discloses an inkjet printing method of printing an area of a substrate in a plurality of passes using curable ink, the method comprising depositing a first pass of ink on the area; partially curing ink deposited in the first pass; depositing a second pass of ink on the area; and fully curing the ink on the area.

WO 03/074619 (DOTRIX/SERICOL) discloses a single pass inkjet printing process comprising the steps of applying a first ink drop to a substrate and subsequently applying a second ink drop on to the first ink drop without intermediate solidification of the first ink drop, wherein the first and second ink drops have a different viscosity, surface tension or curing speed. In the examples, the use of a high-speed single pass inkjet printer was disclosed for printing UV-curable inks on a PVC substrate by a 'wet-on-wet printing' process, wherein the first/subsequent ink drops are not cured, i.e. they are not irradiated prior to application of the next ink drop. In this way an increase in the ink spreading can be realized due to the increased volume of ink of the combined ink drops on the substrate. However, although the spreading of the ink can be increased in this manner, neighbouring drops on the ink-receiver tend to coalescence and bleed into each other, especially on non-absorbing ink-receivers having a small surface energy.

Problems with gloss homogeneity are observed when the printing speed increases, such as e.g. in single pass inkjet printing. EP 1930169 A (AGFA GRAPHICS) discloses a UV-curable inkjet printing method using a first set of printing passes during which partial curing takes place, followed by a second set of passes during which no partial curing takes place for improving the gloss homogeneity.

In WO 03/074619 (DOTRIX/SERICOL), discussed above, 'wet-on-wet' single pass printing is disclosed (which is also called 'wet in wet'). Different inks, e.g. inks of different colors, may be printed wet-on-wet.

EP 2335940 (Agfa Graphics) discloses a single pass inkjet printing method exhibiting high image quality, wherein a first ink having a specified dynamic surface tension is partially cured on an ink receiver, after which a second ink, having a specified dynamic surface tension, is jetted on the ink receiver. Such a printing method may be called "wet on semi-dry". It requires good adjustment of the curing parameters and the ink properties.

There is still a need for an apparatus and a method for single pass inkjet printing exhibiting high image quality.

SUMMARY OF THE INVENTION

Preferred embodiments of the present invention reduce or eliminate deficiencies and problems associated with the prior art devices and methods. Preferred embodiments of the herein disclosed devices and methods for single pass inkjet printing solve or greatly reduce the effects of one or more of the following problems: the visibility of lines or other artefacts in the printed image due to dot placement errors of the print head, due to failing nozzles in the print head, due to cross talk, due to sideshooters, due to coalescence, due to bleeding (all of which are discussed in detail below).

It has been discovered that single pass inkjet printed images were obtained which exhibited very good image quality without requiring a surface treatment such as corona, even on non-absorbing ink-receivers having a small surface energy, by dividing the ink of a particular type, e.g. ink of a particular color, in portions, e.g. in two portions, and by curing the first portion of the ink after it was jetted on the ink-receiver, and by subsequently jetting the other portion(s) of the ink.

In order to overcome the problems described above, preferred embodiments of the present invention provide an inkjet printing device for single pass printing as described below, and a single pass inkjet printing method as also described below.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Definitions

Figure 1:
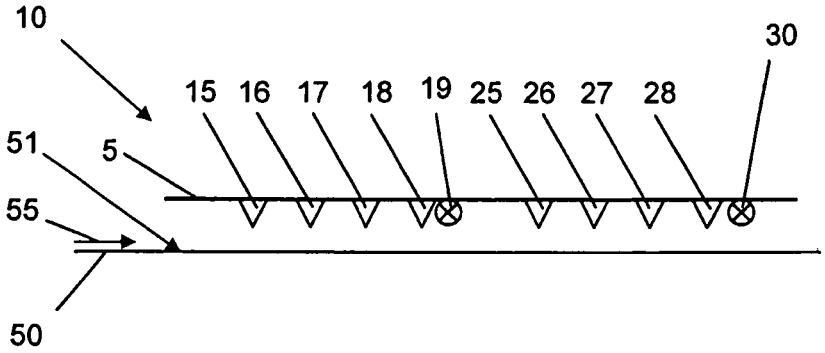
FIG. 1 is a schematic representation of a preferred embodiment of an inkjet printing device in accordance with the invention.

The term "radiation curable ink" means that the ink is curable by "a radiation curing device", which are in this document UV radiation or e-beam.

The term "substantially non-absorbing ink-jet ink-receiver" means any ink-jet ink-receiver which fulfills at least one of the following two criteria:

1) No penetration of ink into the ink-jet ink-receiver deeper than 2 μm;

2) No more than 20% of a droplet of 100 pL (picoliter) jetted onto the surface of the ink-jet ink-receiver disappears into the ink-jet ink-receiver in 5 seconds. If one or more coated layers are present, the dry thickness should be less than 5 μm. Standard analytical method can be used by one skilled in the art to determine whether an ink-receiver falls under either or both of the above criteria of a substantially non-absorbing ink-receiver. For example, after jetting ink on the ink-receiver surface, a slice of the ink-receiver can be taken and examined by transmission electron microscopy to determine if the penetration depth of the ink is greater than 2 μm. Further information regarding suitable analytical methods can be found in the article: DESIE, G, et al. Influence of Substrate Properties in Drop on Demand Printing. *Proceedings of Imaging Science and Technology's 18th International Conference on Non Impact Printing.* 2002, p. 360-365.

The term "mutually interstitial printing" means that an image to be printed is split up in a set of sub-images, each sub-image comprising printed parts and spaces, and wherein at least a part of the spaces in one printed sub-image form a location for the printed parts of another sub-image, and vice versa. The sub-images are then mutually interstitial. Mutually interstitial printing is discussed in detail in U.S. Pat. No. 6,679,583 (AGFA).

In some embodiments of the present invention, the inkjet printing device comprises two sets of nozzles that are positioned in a staggered pattern with respect to each other, and that are further arranged such that the two sub-images that are printed by these two sets of nozzles are mutually interstitial. In a preferred embodiment, a cascade of two print heads is used that each have an array of nozzles that are staggered with respect to each other, and that are arranged for printing mutually interstitial sub-images.

According to a first aspect of the invention, the invention provides in one preferred embodiment an inkjet printing device for single pass printing on a surface of an ink-receiver, the device comprising a plurality of sets of nozzles for jetting N inks on the surface, wherein N is larger than or equal to one, the N inks comprising a first ink, and wherein the plurality of sets of nozzles comprises a first and a second set of nozzles for jetting the first ink; a radiation curing station for curing the first ink when jetted on the surface by the first set of nozzles, wherein the radiation curing station is positioned between the first set of nozzles and the second set of nozzles.

Single Pass Inkjet Printing Devices and Methods

In a preferred embodiment of the inkjet printing device, the radiation curing station is adapted for pin curing of the first ink when jetted on the surface by the first set of nozzles.

In a preferred embodiment of the inkjet printing device, the radiation curing station is stationary in the device and the device further comprises an appliance for moving the ink-receiver with respect to the radiation curing station.

In a preferred embodiment of the inkjet printing device, the first set of nozzles is arranged for printing a first sub-image on the surface and the second set of nozzles is arranged for printing a second sub-image on the surface, and the second set of nozzles is positioned in a staggered pattern with respect to the first set of nozzles, such that the first and the second sub-images are mutually interstitial.

In a preferred embodiment of the inkjet printing device, the device includes eight sets of nozzles for jetting four inks on the surface, a black, a cyan, a magenta and a yellow ink, wherein the eight sets of nozzles comprise two sets of nozzles for each of the four inks, and wherein the radiation curing station is positioned between the first set of nozzles for jetting the black ink, the first set of nozzles for jetting the cyan ink, the first set of nozzles for jetting the magenta ink and the first set of nozzles for jetting the yellow ink, upstream of the radiation curing station, and the second set of nozzles for jetting the black ink, the second set of nozzles for jetting the cyan ink, the second set of nozzles for jetting the magenta ink and the second set of nozzles for jetting the yellow ink, downstream of the radiation curing station.

In a preferred embodiment of the inkjet printing device, the device includes, for each of the N inks, two sets of nozzles.

In a preferred embodiment of the inkjet printing device, the device includes, for each of the N inks, three sets of nozzles.

In a preferred embodiment of the inkjet printing device, the device includes, for each of the N inks, four or more sets of nozzles.

In a preferred embodiment of the inkjet printing device, the device includes a radiation curing station for final curing of the N inks when jetted on the surface by the plurality of sets of nozzles.

In a preferred embodiment of the inkjet printing device, the plurality of sets of nozzles has a set of resolutions, each specific set of nozzles out of the plurality of sets of nozzles having a specific resolution, the device further comprising a piezoelectric print head configured to jet ink drops through the plurality of sets of nozzles, wherein the ink drops have ink drop sizes; to control the ink drop sizes, wherein the ink drop sizes include a specific ink drop size for each of the specific set of nozzles; and to control jetting frequencies for jetting the ink drops, wherein the jetting frequencies include a specific jetting frequency for each of the specific set of nozzles; wherein the set of resolutions, the ink drop sizes and the jetting frequencies are adapted to jet an image on the surface of the ink-receiver, at full coverage of the surface, at less than 6 $g/m^2$ of ink, preferably at less than 5 $g/m^2$ of ink, more preferably at less than 4 $g/m^2$ of ink.

In one preferred embodiment of the invention, no pin curing is applied for yellow ink. E.g. black, cyan and magenta inks are jetted in two portions, with pin curing after the first portions of black, cyan and magenta ink are jetted; then black, cyan, magenta and yellow ink are jetted, followed by final curing.

According to another aspect of the invention, the invention provides in one preferred embodiment a single pass inkjet printing method comprising the steps of:

- jetting N inks on a surface of an ink-receiver, wherein N is larger than or equal to one;
- jetting a portion of a first ink out of the N inks on the surface by a first set of nozzles;
- radiation curing the portion of the first ink jetted on the surface;
- jetting another portion of the first ink on the surface, by a second set of nozzles, after the radiation curing the portion of the first ink.

In a preferred embodiment of the single pass inkjet printing method, the radiation curing the portion of the first ink is a pin curing the portion of the first ink.

In a preferred embodiment of the single pass inkjet printing method, the radiation curing the portion of the first ink is performed by a radiation curing station that is held stationary, and the method further comprises the step of moving the ink receiver with respect to the radiation curing station.

In a preferred embodiment of the single pass inkjet printing method, the method comprises the steps of:

- jetting a portion of a second ink out of the N inks on the surface, wherein the second ink is different from the first ink;
- radiation curing the portion of the first ink jetted on the surface and the portion of the second ink jetted on the surface;
- jetting another portion of the second ink on the surface after the radiation curing the portion of the first ink and the portion of the second ink.

In one preferred embodiment of the single pass inkjet printing method, the method comprises the steps of jetting a portion of cyan ink, subsequently a portion of magenta ink, and subsequently a portion of yellow ink on the surface, radiation curing these portions of ink, and then jetting another portion of yellow ink, subsequently another portion of magenta ink and subsequently another portion of cyan ink on the surface.

In a preferred embodiment of the single pass inkjet printing method, the method comprises the steps of:

- jetting a first set of ink drops through the first set of nozzles, thus forming a first sub-image on the surface;
- jetting a second set of ink drops through the second set of nozzles, thus forming a second sub-image on the surface;

wherein the second set of ink drops is jetted in a staggered pattern with respect to the first set of ink drops such that the first and the second sub-images are mutually interstitial.

In a preferred embodiment of the single pass inkjet printing method, the ink-receiver is a substantially non-absorbing inkjet ink-receiver.

In a preferred embodiment of the single pass inkjet printing method, the method comprises jetting sets of ink drops through a plurality of sets of nozzles on the surface, at a set of resolutions and at jetting frequencies, the ink drops having ink drop sizes, each specific set of ink drops out of the sets of ink drops being jetted, through a specific set of nozzles out of the plurality of sets of nozzles, at a specific resolution and at a specific jetting frequency; and adapting the set of resolutions, the jetting frequencies and the ink drop sizes such that an image is jetted on the surface of the ink-receiver, at full coverage of the surface, at less than 6 $g/m^2$ of ink, preferably at less than 5 $g/m^2$ of ink, more preferably at less than 4 $g/m^2$ of ink.

In a preferred embodiment of the single pass inkjet printing method, the method comprises final curing the N inks jetted on the surface Inkjet Printers The concept and construction of single pass inkjet printers are well known to the person skilled in the art. An example of such a single pass inkjet printer is: Dotrix Modular from Agfa Graphics. A single pass inkjet printer for printing UV curable ink onto an ink-receiver typically contains one or more inkjet print heads, a transporting device arranged to transport the ink receiver beneath the print head(s), a curing device (UV or e-beam) and electronics to control the printing procedure.

The single pass inkjet printer is preferably at least capable of printing cyan (C), magenta (M), yellow (Y) and black (K) inkjet inks. In a preferred embodiment, the CMYK inkjet ink set used in the single pass inkjet printer may also be extended with extra inks such as red, green, blue, orange and/or violet to further enlarge the color gamut of the image. White ink may also be used, e.g. to increase the opacity of the ink-receiver. The CMYK ink set may also be extended by the combination of full density and light density inks of color inks and/or black inks to improve the image quality by lowered graininess.

Inkjet Print Heads

The radiation curable inks may be jetted by one or more printing heads ejecting small droplets of ink in a controlled manner through nozzles onto an ink-receiving surface, which is moving relative to the printing head(s).

A preferred print head for the inkjet printing system is a piezoelectric head. Piezoelectric inkjet printing is based on the movement of a piezoelectric ceramic transducer when a voltage is applied thereto. The application of a voltage changes the shape of the piezoelectric ceramic transducer in the print head creating a void, which is then filled with ink. When the voltage is again removed, the ceramic expands to its original shape, ejecting a drop of ink from the print head. However the inkjet printing method according to the present invention is not restricted to piezoelectric inkjet printing. Other inkjet printing heads can be used and include various types, such as a continuous type and thermal, electrostatic and acoustic drop on demand type.

At high printing speeds, the inks must be ejected readily from the printing heads, which puts a number of constraints on the physical properties of the ink, e.g. a low viscosity at the jetting temperature, which may vary from 25° C. to 110° C., a surface energy such that the print head nozzle can form the necessary small droplets, a homogenous ink capable of rapid conversion to a dry printed area, etc.

In so-called multi-pass inkjet printers, the inkjet print head scans back and forth in a transversal direction across the moving ink-receiver surface, but in a "single pass printing process", the printing is accomplished by using page wide inkjet printing heads or multiple staggered inkjet printing heads which cover the entire width of the ink-receiver surface. In a single pass printing process the inkjet printing heads preferably remain stationary while the ink-receiver surface is transported under the inkjet printing head(s). All curable inks have then to be cured downstream of the printing area by a radiation curing device.

By avoiding the transversal scanning of the print head, high printing speeds can be obtained. In the single pass inkjet printing method according to a preferred embodiment of the present invention, the printing speed is preferably at least 35 m/min, more preferably at least 50 m/min. The resolution of the single pass inkjet printing method according to a preferred embodiment of the present invention is preferably at least 180 dpi, more preferably at least 300 dpi. The ink-receiver used in the single pass inkjet printing method according to a preferred embodiment of the present invention has preferably a width of at least 240 mm, more preferably the width of the ink-receiver is at least 300 mm, and particularly preferably at least 500 mm.

Curing Device

A suitable single pass inkjet printer according to a preferred embodiment of the present invention preferably contains the necessary curing device for providing a partial and a final curing treatment. Radiation curable inks can be cured by exposing them to actinic radiation. These curable inks preferably comprise a photoinitiator which allows radiation curing, preferably by ultraviolet radiation.

In a preferred embodiment a static fixed radiation source is employed. The source of radiation arranged is preferably an elongated radiation source extending transversely across the ink-receiver surface to be cured and positioned down stream from the inkjet print head.

Many light sources exist in UV radiation, including a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 320 nm to 400 nm

UV-B: 290 nm to 320 nm

UV-C: 100 nm to 290 nm.

Furthermore, it is possible to cure the image using two different light sources differing in wavelength or illuminance. For example, the first UV-source for partial curing can be selected to be rich in UV-A, e.g. an iron-doped lamp, and the UV-source for final curing can then be rich in UV-C, e.g. a non-doped lamp.

In a preferred embodiment of the apparatus according to the present invention, the radiation curable inkjet inks receive a final curing treatment by e-beam or by a mercury lamp.

In a preferred embodiment of the apparatus according to the present invention, the partial curing is performed by UV LEDs.

The terms "partial cure", "pin cure", and "full cure" refer to the degree of curing, i.e, the percentage of converted functional groups, and may be determined by for example RT-FTIR (Real-Time Fourier Transform Infra-Red Spectroscopy) a method well known to the one skilled in the art of curable formulations. A partial cure, also called a pin cure, is defined as a degree of curing wherein at least 5%, preferably at least 10%, of the functional groups in the coated formulation is converted. A full cure is defined as a degree of curing wherein the increase in the percentage of converted functional groups, with increased exposure to radiation (time and/or dose), is negligible. A full cure corresponds with a conversion percentage that is within 10%, preferably within 5%, from the maximum conversion percentage defined by the horizontal asymptote in the RT-FTIR graph (percentage conversion versus curing energy or curing time).

For facilitating curing, the inkjet printer preferably includes one or more oxygen depletion units. A preferred oxygen depletion unit places a blanket of nitrogen or other relatively inert gas (e.g. $CO_2$) with adjustable position and adjustable inert gas concentration, in order to reduce the oxygen concentration in the curing environment. Residual oxygen levels are usually maintained as low as 200 ppm, but are generally in the range of 200 ppm to 1200 ppm.

Inkjet Inks

The inks used in the tests were the CMYK inkset Agora G1 available from Agfa Graphics NV.

EXAMPLES

Measurement Methods

Intercolor Bleeding

The inter-color bleeding of inks occurs when two colors overlap and create unwanted color mixing. Bleeding was evaluated by printing 0.1 mm lines of one color between broader lines of another color, e.g. 0.1 mm black lines between broader yellow lines. The evaluation was made in accordance with a criterion as described in Table 1.

TABLE 1

| Criterion | Observation |
|---|---|
| ++ | no bleeding |
| + | almost no bleeding visible by microscope |
| − | bleeding visible by microscope |
| −− | some bleeding to be seen by the naked eye |
| −−− | bleeding to be seen by the naked eye |

Mottle

The ink-jet ink-receiver must be readily wetted by the inkjet inks so that there is no "mottling", i.e. anisotropic coalescence of adjacent ink-droplets to form larger patches with varying volume on a scale that is much larger than the dot interdistance. This results in a fluctuation of density in the concerned image portions. A visual evaluation was made in accordance with a criterion described in Table 2.

TABLE 2

| Criterion | Observation |
|---|---|
| ++ | no mottle |
| + | almost no mottle |
| − | mottle giving moderate decrease in quality |
| −− | mottle giving annoying decrease in quality |
| −−− | mottle giving severe decrease in quality |

Side Shooters

Visibility of side shooters was evaluated by using an ink jet print head of which dot placement measurements showed that some of the nozzles throw the jetted drops more than 8 μm off target. With this ink jet print head uniform areas were printed, of which visual uniformity was evaluated.

TABLE 3

| Criterion | Observation |
|---|---|
| ++ | no inhomogeneities in uniform printed area visible |
| + | almost no inhomogeneities in uniform printed area visible |
| − | some small inhomogeneities in uniform printed area visible |
| −− | large inhomogeneities in uniform printed area visible |
| −−− | very large and many inhomogeneities in uniform printed area visible |

Gloss Differences

In images, printed surfaces tend to be matte at lower ink loads and tend to become highly glossy as more ink is applied to a certain surface area. In some situations, at very high ink loads (e.g. shadows in an image) the appearance suddenly becomes matte again. In other words, in some cases the surface gloss appearance of a gradient or step wedge, containing all ink loads, will vary as a function of ink load.

The surface gloss appearance of a practical image and a step wedge image were evaluated under a 20°, 45° and 75° angle, opposite to the direction of the lighting which, at its turn, is at the same angle to the illuminated surface.

TABLE 4

| Criterion | Observation |
|---|---|
| ++ | Balanced gloss appearance throughout the ink load range |
| + | Slight gloss differences visible |
| − | Matte low ink loads, glossy higher ink loads |
| −− | Matte low ink loads. Some of the high ink loads become matte, glossy intermediate ink loads |
| −−− | Matte low ink loads, matte high ink loads, glossy in between |

Failing Nozzles

Appearance of a failing nozzle was simulated by entering a data value of 0 for a specific nozzle at a location that will traverse the whole range of densities, from very light to very dark printed densities.

In the printed images, the visibility of this line was evaluated.

TABLE 5

| Criterion | Observation |
|---|---|
| ++ | Failing nozzle line not visible |
| + | Failing nozzle line hardly visible |
| − | Failing nozzle line visible in some densities |
| −− | Failing nozzle line visible in all densities |
| −−− | Failing nozzle line clearly visible |

Strikethrough

Strikethrough was only evaluated on a G-Print paper. With this particular substrate, strikethrough is seen as little stains of ink visible at the non-printed side of the substrate. High ink load areas are more likely to show stains on the non-printed side of the substrate.

TABLE 6

| Criterion | Observation |
|---|---|
| ++ | No stains visible at the non printed side |
| − | A few stains visible at the non printed side in the highest ink load areas |
| −−− | Stains visible at the non printed side in the highest ink load areas |

Sharpness Microscope

The appearance of very small structures (1 pixel wide) was evaluated after magnification with a digital microscope (200×). The way in which sharpness is retained was evaluated.

TABLE 7

| Criterion | Observation |
|---|---|
| ++ | Very sharp line visible |
| + | Line looses some sharpness |
| − | Line slightly broadened or feathered out |
| −− | Line visibly broadened or feathered out |
| −−− | Line is very clearly broadened or feathered out |

Materials

HIFI is a substantially non-absorbing polyester film available as HiFi™ PMX749 from HiFi Industrial Film (UK), which has a surface energy of 37 mJ/m$^2$.

G-Print is a wood-free coated paper from Arctic Paper.

UPM/PE is a white, glossy polyethylene film from Raflatac.

Inkjet Printer

A custom built single pass inkjet printer was used, which had an undercarriage on which a linear motor was mounted. The sled of the linear motor was attached to a substrate table. Ink-receivers are held in place on the substrate table by a vacuum suction system. A bridge was built on the undercarriage perpendicular to the direction of the linear motor. Connected to the bridge a cage for the print heads was mounted. This cage was provided with the necessary mechanical adjustment device to align the print heads such that they could one by one print the same surface on the substrate table moving beneath them in a single pass.

Figure 2:
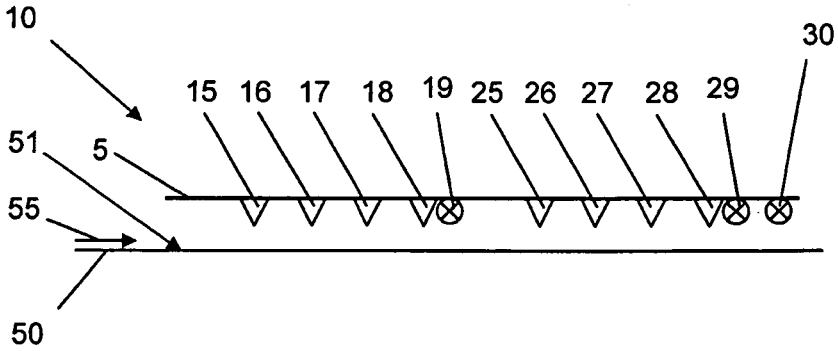
FIG. 2 is a schematic representation of another preferred embodiment of an inkjet printing device in accordance with the invention.

FIG. 2 schematically shows a side view of a preferred embodiment of the single pass inkjet printer 10. On the cage 5 eight inkjet print heads (KJ4A type from Kyocera) were mounted, in two groups of four print heads, each print head having a set of nozzles 15-18, 25-28 for jetting a type of ink. The ink-receiver 50 was moved with respect to the print heads by the linear motor in the direction of arrow 55. The print heads jetted ink on surface 51 of the ink-receiver 50, in the order KCMY, i.e. a first portion of black ink was jetted through the set of nozzles 15, then a first portion of cyan ink was jetted through the set of nozzles 16, then a first portion of magenta ink though the set of nozzles 17, and subsequently a first portion of yellow ink through the set of nozzles 18. After pin curing, by pin curing station 19, a second portion of black ink was jetted through the set of nozzles 25, and then second portions of cyan, magenta and yellow ink were jetted through respectively the sets of nozzles 26, 27 and 28. The sets of nozzles 15-18 are upstream of the pin curing station 19 and the sets of nozzles 25-28 are downstream of the pin curing station 19 (upstream and downstream taking into account the moving direction 55 of the ink-receiver). The first and the second portion of a type of ink, e.g. of black ink, may be stored in one and the same container. In another embodiment, the first and the second portion of a type of ink are stored in two different containers.

The jetted ink was cured by radiation curing stations 19, 29, 30, as discussed further below.

The linear motor and the inkjet print heads were controlled by a specific program and separate electronic circuits. The synchronization between the linear motor and the inkjet print heads was possible because the encoder pulses of the linear motor were also fed to the electronic circuits that controlled the inkjet print heads. The firing pulses of the inkjet print heads were supplied synchronously with the encoder pulses of the linear motor and thus in this manner the movement of the substrate table was synchronized with the inkjet print head. The software driving the print heads could translate any CMYK encoded image into control signals for the print heads.

Each print head had its own ink supply. The main circuit was a closed loop, wherein circulation was provided by a pump. This circuit started from a header tank, mounted in the immediate vicinity of the inkjet print head, to a degassing membrane and then through a filter and the pump back to the header tank. The membrane was impervious to ink but permeable to air. By applying a strong underpressure on one side of the membrane, air was drawn from the ink located on the other side of the membrane.

The function of the header tank is threefold. The header tank contains a quantity of permanently degassed ink that can be delivered to the inkjet print head. Secondly, a small underpressure was exerted in the header tank to prevent ink leakage from the print head and to form a meniscus in the ink jet nozzle. The third function was that by a float in the header tank the ink level in the circuit could be monitored.

Furthermore, two short channels were connected to the closed loop: one input channel and one output channel. On a signal from the float in the header tank, a quantity of ink from an ink storage container was brought via the input channel into the closed circuit just before the degassing membrane. The short output channel ran from the header tank to the inkjet print head, where the ink was consumed, i.e. jetted on the ink receiver.

The radiation curing stations 19, 29, 30 encompassed a final curing station 30 including two UV mercury vapor lamps, and two UV LED curing stations, 19 and 29, for pin curing. The radiation curing stations 19, 29, 30 were moveably connected to two fixed rails. The two LED curing stations 19, 29 for pin curing were each placed immediately after a group of four CMYK print heads. The LED curing stations were water cooled UV LED modules from Integration Technology, emitting UV light with peak intensity at 395 nm. The two mercury vapor lamps 30, which were one iron doped mercury lamp and one undoped mercury lamp, were positioned at the end of the two fixed rails after the substrate table had passed the inkjet print heads and the LED curing stations, in order to provide a final cure. The UV LED curing stations 19, 29 and the mercury vapor lamps 30 were individually adjustable in terms of guidance and outputted power UV light. By positioning the iron doped mercury vapor lamps 30 closer to or further away from the print head, the time to cure after jetting could be decreased respectively increased.

In another embodiment, shown in FIG. 1, the second UV LED curing station 29 immediately preceding the final curing station 30 was omitted. The final curing station was then positioned close to the last print head, with the set of nozzles 28 at a distance of 15 cm from this set of nozzles, so that final curing was preformed quickly after the last drops of ink were jetted on the ink-receiver 50 (a typical transport speed of the ink-receiver with respect to the print heads was 50 m/min).

Figure 3:
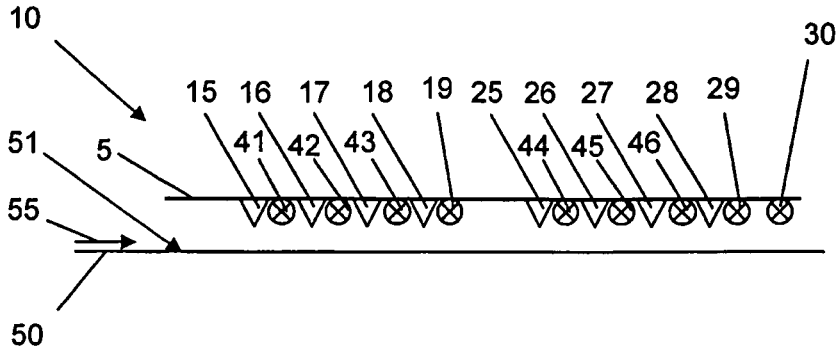
FIG. 3 is a schematic representation of yet another preferred embodiment of an inkjet printing device in accordance with the invention.

Yet another preferred embodiment is shown in FIG. 3. This preferred embodiment includes additional pin curing stations 41-43, 44-46, so that each portion of ink, jetted by one set of nozzles 15, 16, 17, 18, 25, 26, 27, 28, may now immediately be pin cured before the next portion of ink is jetted by the next set of nozzles.

Figure 4:
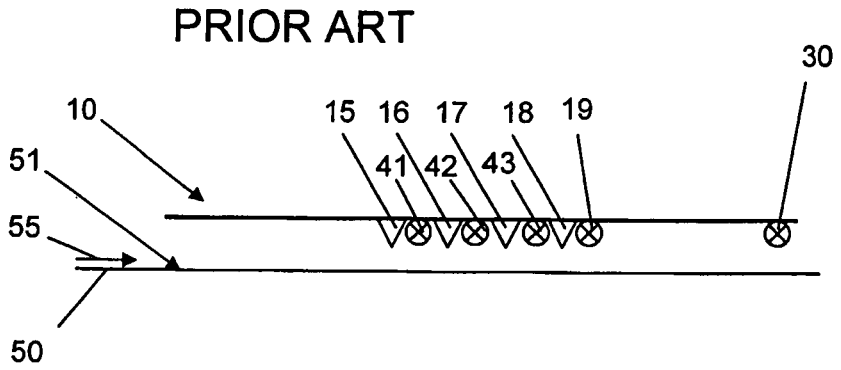
FIG. 4 is a schematic representation of an embodiment of an inkjet printing device in accordance with the prior art, for a "wet on semi-dry" printing method as discussed above.

FIG. 4 shows an embodiment of a prior art inkjet printing device for a "wet on semi-dry" printing method as discussed above. Here also a pin curing station is provided after each print head, but the ink of one type, e.g. of one specific color, is not jetted in two or more portions as is the case in the preferred embodiment of FIG. 3.

Embodiments in accordance with the invention provide better image quality, as is shown by the test results discussed further below. This is a very important advantage. Moreover, since the effects of failing nozzles in the print head, of dot placement errors of the print head, etc., are significantly masked in the printed image, print heads that are or that become defective only have to be replaced much later than is customary, which leads to a considerable increase in system lifetime. One of the advantages of some embodiments of the invention is that the visibility of the effects of cross talk in the print heads is reduced. Cross talk may cause erroneous dot placement and/or drop volume differences between neighboring nozzles, and is due e.g. to mechanical and/or hydraulic coupling between side-by-side ink channels in a piezoelectric print head.

Another advantage of the embodiments of FIGS. 1 and 2 is that less curing stations are required, which still further reduces cost.

Figure 5:
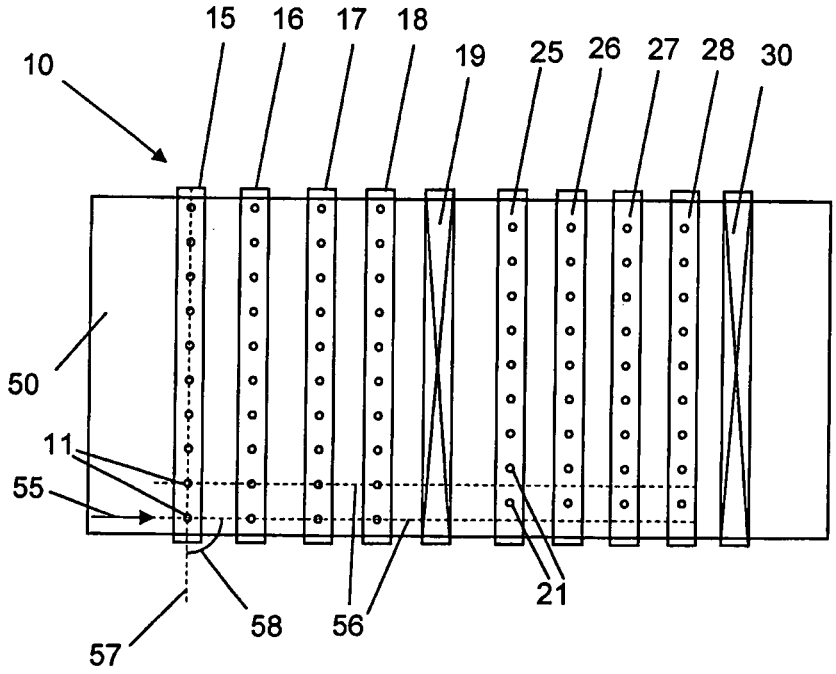
FIG. 5 is a schematic representation of the top view of a preferred embodiment of an inkjet printing device in accordance with the invention.

FIG. 5 schematically shows a top view of a preferred embodiment of an inkjet printing device in accordance with the invention. The configuration of the radiation curing stations 19, 30 is the same as the one shown in the preferred embodiment of FIG. 1. In the preferred embodiment of FIG. 5, the sets of nozzles 25-28 are positioned in a staggered pattern with respect to the sets of nozzles 15-18. Nozzles 21, that belong to the set of nozzles 25, are not positioned on lines 56, which are lines through nozzles 11 of nozzle set 15 and in the moving direction 55 of the ink-receiver. The nozzles of nozzle sets 16, 17 and 18 are positioned on these lines, but the sets of nozzles 25, 26, 27 and 28 are staggered with respect to the sets of nozzles 15-18. Further, the firing pulses supplied to the print heads comprising the sets of nozzles 15-18 and the firing pulses to the print heads comprising the sets of nozzles 25-28 are preferably timed such that the first sub-image jetted by the sets of nozzles 15-18 and the second sub-image jetted by the sets of nozzles 25-28 are mutually interstitial.

In the preferred embodiment shown in FIG. 5, the nozzles 11 of the set of nozzles 15 of the first print head are on a line 57 that makes an angle 58 of 90° with line 56 that is in the moving direction 55 of the ink-receiver 50. In another embodiment, this angle 58 may be less than 90°, and the sets of nozzles 25-28 may still be positioned in a staggered pattern with respect to the sets of nozzles 15-18.

Another advantage is that the ink load may be reduced. Instead of about 6 g/m$^2$ of ink or more, as is customary, the ink load on the ink-receiver may be 6 g/m$^2$ or less, preferably 5.5 g/m$^2$ or less, more preferably 5 g/m$^2$ or less, even more preferably 4.5 g/m$^2$ or less, and most preferably 4 g/m$^2$ or less, at full coverage of the surface of the ink-receiver. The ink load is determined by measuring the difference in weight between the ink-receiver including the wet ink, i.e. before curing, and the ink-receiver before the ink is jetted. An advantage of a reduced ink load is that it is less expensive to print an image. Another advantage is that the ink-receiver with the image is more flexible, i.e. it can be bent more easily, without damages (e.g. without making cracks) in the image.

In order to obtain such a reduced ink load, the resolution of the printed image and the ink drop size may be adjusted. When using grayscale printheads, especially the smallest ink drop size may be adjusted; the lowest drop size may then preferably be less than or equal to 4 pL, more preferably less than or equal to 3 pL.

Take for example a prior art inkjet printing device, as illustrated in FIG. 4, wherein the printing resolution is e.g. 600 by 600 dpi (dots per inch). The nozzle pitch, which is the distance between the nozzles of a print head (nozzles 11 as shown in FIG. 5), is then such that there are 600 nozzles per inch along the print head (remark: in the schematic illustration of FIG. 5, only one row of nozzles 11 per set of nozzles 15 is shown, but, as known in the prior art, a print head may include two rows of nozzles, or it may even have more than two rows of nozzles). Further, the firing pulses of the inkjet print heads are such that, taking into account the moving speed of the ink-receiver relative to the print heads, the drops of ink that are jetted in response to these firing pulses form a grid of 600 by 600 dpi on the ink-receiver. The ink jetted on the ink receiver forms, on the grid points, drops having a drop size of e.g. 11 pL.

In some embodiments of an inkjet printing device 10 in accordance with the invention, two sets of nozzles are used per ink, e.g. sets of nozzles 15 and 25 in FIG. 5, that are positioned in a staggered pattern with respect to each other. To compare an preferred embodiment of the invention with the prior art inkjet printing device printing at 600 by 600 dpi, the inkjet printing device illustrated in FIG. 5 then has sets of nozzles 15-18, 25-28 that each have a resolution of 600 nozzles per inch, wherein the second group of sets of nozzles 25-28 is staggered with respect to the first group of sets of nozzles 15-18, over half a nozzle pitch in the direction of line 57, as shown in FIG. 5. The jetting frequency for jetting ink drops (corresponding to the firing pulses of the inkjet print heads) is such that the ink drops on the ink-receiver jetted by a selected set of nozzles, e.g. set 25, form an equidistant grid with grid points that are positioned in the center of the squares formed by the grid points of the equidistant grid that is formed by the ink drops on the ink-receiver jetted by the set of nozzles, in this case set 15, of the first group of nozzles that jets the same ink as the selected set of nozzles 25 of the second group of nozzles. The image resolution is now 848 by 848 dpi (this is 600 times the square root of two (1.4142), since the shortest distance between two points on the combined grid of the sets of nozzles 15 and 25 is the grid distance of a 600 by 600 dpi grid divided by 1.4142). Ink drops may now be jetted that have an ink drop size of 5.5 pL, i.e. half of the 11 pL drops, to obtain the same ink load as in the prior art 600 by 600 dpi example.

If, instead of using a prior art configuration of single pass printing at 600 by 600 dpi using ink drops up to 11 pL, a prior art configuration of single pass printing at X by X dpi is used with ink drops up to Y pL, in some embodiments of the invention a single pass double print head configuration of 1.4142*X (X times the square root of two) by 1.4142*X may be used with ink drops up to Y/2 pL.

We have found that the ink load may be reduced while still obtaining high quality images. Printing at 600 by 600 dpi using ink drops of 11 pL leads to an ink load of 6 g/m$^2$ at full coverage of the printed surface (i.e. an ink drop is deposed on each grid point on the surface). In some embodiments of the invention, in the single pass double print head configuration the ink drop size is reduced so that, at full coverage of the surface, an ink load of less than 6 g/m$^2$ is obtained; in other embodiments, an ink load of less than 5.5 g/m$^2$ is obtained; in still other embodiments, an ink load of less than 5 g/m$^2$ is obtained; in yet other embodiments, an ink load of less than 4.5 g/m$^2$ is obtained; in some other embodiments, an ink load of less than 4 g/m$^2$ is obtained. Instead of reducing the ink drop size, the ink drop size may be kept unchanged, and the image resolution may be changed, by enlarging the distance between the grid points of the grid on the ink-receiver, e.g. by using a different kind of print heads having a different nozzle pitch and by modifying the firing frequency of the print heads. In general, the resolution of the sets of nozzles, the jetting frequency for jetting the ink drops, and the ink drop size may be mutually adjusted such that a reduced ink load is obtained.

The ink drop size of the drops jetted on the surface is not necessarily the same for all the nozzles; different sets of nozzles may be used that each are adapted for different ink drop sizes (remark: the "ink drop size", in pL, as discussed above, is in fact the standard maximum ink drop size as jetted through the nozzle of the print head; many print heads are binary or gray scale print heads that can deliver a number of drop sizes, e.g. 5.5 and 11 pL). E.g. the sets of nozzles upstream of the intermediate curing station may be configured to print at 600×600 dpi, and the sets of nozzles downstream of the intermediate curing station configured to print at 300×300 dpi and at a larger ink drop size, or vice versa, i.e. first the nozzles at lower resolution jet ink on the ink-receiver, followed, after intermediate pin curing, by the nozzles at higher resolution. Further, not all sets of nozzles need to have the same resolution, and the jetting frequencies of the nozzles is not necessarily the same for all nozzles.

In one preferred embodiment of an inkjet printing device for single pass printing on an ink-receiver having a surface, the device comprises a piezoelectric print head including a plurality of sets of nozzles for jetting inks on the surface, the plurality of sets of nozzles including a first and a second set of nozzles for jetting a first ink, wherein the plurality of sets of nozzles has a set of resolutions, each specific set of nozzles out of the plurality of sets of nozzles having a specific resolution, the piezoelectric print head configured to jet ink drops through the plurality of sets of nozzles, wherein the ink drops have ink drop sizes; to control the ink drop sizes, wherein the ink drop sizes include a specific ink drop size for each of the specific set of nozzles; and to control jetting frequencies for jetting the ink drops, wherein the jetting frequencies include a specific jetting frequency for each of the specific set of nozzles; wherein the set of resolutions, the ink drop sizes and the jetting frequencies are adapted to jet an image on the surface of the ink-receiver, at full coverage of the surface, at less than 5.5 g/m$^2$ of ink. The inkjet printing device may further comprise a radiation curing station for curing the first ink when jetted on the surface by the first set of nozzles, wherein the radiation curing station is positioned between the first set of nozzles and the second set of nozzles.

Further, when this ink load reduction is applied, inks with a higher pigment concentration (or, if dyes would be used, with a higher dye concentration) may be used. In order to keep the graininess on the same level, preferably the size of the smallest drop volume is then reduced, as discussed already above.

Results and Evaluation

The Agora G1 inks were jetted on respectively the three materials HIFI, G-Print and UPM/PE, in two portions, with intermediate pin curing, and in the order KCMY, i.e. first the black ink was jetted, then the cyan, magenta and yellow inks, followed by curing in a UV LED curing station, followed by jetting of KCMY inks, by curing in a UV LED curing station, and then by final curing in a final curing station of one iron doped mercury lamp and one undoped mercury lamp.

The moving speed of the ink-receiver with respect to the print heads was 50 m/min. The time lapse between jetting the K and the C inks was 276 ms, which was also the time lapse between the jetting of the C and the M inks, and between the jetting of the M and the Y inks. The time lapse between the jetting of the yellow ink and the curing in the UV LED curing station was 138 ms. The time lapse between the second curing in the UV LED curing station and the final curing was 762 ms.

The curing power was 1212 mW/m$^2$ UV-A2 EIT (370 nm-415 nm), for the UV LED curing stations 19, 29, 41, 42 and 43 (when used) and 4644 mW/m$^2$ UV-A EIT (320 nm-390 nm); 1856 mW/m$^2$ UV-B EIT (280 nm-320 nm); 362 mW/m$^2$ UV-C EIT (245 nm-265 nm); 1873 mW/m$^2$ UV-V EIT (385 nm-440 nm) for the final curing in final curing station 30. The curing power, in W/m$^2$, is the UV radiation as measured with an EIT PowerPuck II.

The test results are compared to wet-on-wet printing and to wet on semi-dry printing, and also to a configuration wherein the inks were jetted in two portions, but without intermediate pin curing.

The wet-on-wet printing was performed in a configuration as shown in FIG. 4 but wherein the curing stations 41, 42, 43 and 19 were not used, i.e. the only curing was the final curing in final curing station 30. For the rest, the test data were the same as disclosed above, i.e. the same moving speed and time lapses between jetting of the subsequent KCMY inks. The time lapse between the jetting of the Y ink and the final curing was 900 ms.

The curing power was 4644 mW/m$^2$ UV-A EIT (320 nm-390 nm); 1856 mW/m$^2$ UV-B EIT (280 nm-320 nm); 362 mW/m$^2$ UV-C EIT (245 nm-265 nm); 1873 mW/m$^2$ UV-V EIT (385 nm-440 nm) for the final curing in final curing station 30. The curing power, in W/m$^2$, is the UV radiation as measured with an EIT PowerPuck II.

The wet on semi-dry printing was performed in the configuration as shown in FIG. 4, with the same test data as disclosed above, and additionally 138 ms between the jetting of an ink and the subsequent at least partial curing in a UV LED curing station 41, 42, 43, 19.

The curing power was 1068 mW/m$^2$ UV-A2 EIT (370 nm-415 nm), for the UV LED curing stations 19, 29, 41, 42 and 43 and 4644 mW/m$^2$ UV-A EIT (320 nm-390 nm); 1856 mW/m$^2$ UV-B EIT (280 nm-320 nm); 362 mW/m$^2$ UV-C EIT (245 nm-265 nm); 1873 mW/m$^2$ UV-V EIT (385 nm-440 nm) for the final curing in final curing station 30. The curing power, in W/m$^2$, is the UV radiation as measured with an EIT PowerPuck II.

In another test set up in accordance with the invention, called in the Tables below the "Invention Hg lamp pin curing", the ink was jetted in two portions, with intermediate pin curing by using an undoped mercury lamp in stead of a UV LED curing station, and in the order KCMY, i.e. first the black ink was jetted, then the cyan, magenta and yellow inks, followed by curing with a undoped mercury lamp, followed by jetting of KCMY inks, and then by final curing in a final curing station of one iron doped mercury lamp and one undoped mercury lamp.

The curing power was 838 mW/m$^2$ UV-A EIT (320 nm-390 nm); 684 mW/m$^2$ UV-B EIT (280 nm-320 nm); 160 mW/m$^2$ UV-C EIT (245 nm-265 nm); 381 mW/m$^2$ UV-V EIT (385 nm-440 nm) for the PIN cure and 4644 mW/m$^2$ UV-A EIT (320 nm-390 nm); 1856 mW/m$^2$ UV-B EIT (280 nm-320 nm); 362 mW/m$^2$ UV-C EIT (245 nm-265 nm); 1873 mW/m$^2$ UV-V EIT (385 nm-440 nm) for the final curing in final curing station 30. The curing power, in W/m$^2$, is the UV radiation as measured with an EIT PowerPuck II.

In yet another test set up, not in accordance with the invention, called in the Tables below "No pin curing", the ink was jetted in two portions, without intermediate pin curing, and in the order KCMY, i.e. first the black ink was jetted, then the cyan, magenta and yellow inks, followed by jetting the second portion of the KCMY inks, and then by final curing in a final curing station of one iron doped mercury lamp and one undoped mercury lamp.

The curing power was 4644 mW/m$^2$ UV-A EIT (320 nm-390 nm); 1856 mW/m$^2$ UV-B EIT (280 nm-320 nm); 362 mW/m$^2$ UV-C EIT (245 nm-265 nm); 1873 mW/m$^2$ UV-V EIT (385 nm-440 nm) for the final curing in final curing station 30. The curing power, in W/m$^2$, is the UV radiation as measured with an EIT PowerPuck II.

The test results for printing on the G-Print material are shown in Table 8. The evaluation was made in accordance with Tables 1-7.

TABLE 8

| | Invention LED pin curing | Invention Hg lamp pin curing | No pin curing | Wet-on-wet | Wet on semi-dry |
|---|---|---|---|---|---|
| Side Shooters | + | −− | + | + | −− |
| Failing Nozzles | − | − | − | − | − |
| Mottle | − | −− | −−− | −− | + |
| Gloss Differences | + | − | + | −− | ++ |
| Intercolor Bleeding | − | −− | −−− | −−− | ++ |
| Strikethrough | − | − | −−− | −−− | ++ |
| Sharpness, microscope | + | + | + | −− | − |

Table 9 shows the results of the printing tests on the UPM/PE material.

TABLE 9

| | Invention LED pin curing | Invention Hg lamp pin curing | No pin curing | Wet-on-wet | Wet on semi-dry |
|---|---|---|---|---|---|
| Side Shooters | −− | −− | + | −−− | −−− |
| Failing Nozzles | − | − | + | −−− | −−− |
| Mottle | − | −− | −−− | −−− | −−− |
| Gloss Differences | + | + | −−− | −−− | −− |
| Intercolor Bleeding | − | −− | −−− | −−− | + |
| Strikethrough | NA | NA | NA | NA | NA |
| Sharpness, microscope | + | + | −−− | − | + |

The results of the printing tests on the HIFI material are shown in Table 10. Because HIFI is a substantially non-absorbing material, it is very difficult to obtain good printing results.

For the "invention LED pin curing" test in Table 10, the curing power was 2011 mW/m$^2$ UV-A2 EIT (370 nm-415 nm), for the UV LED curing stations 19 and 29 and 4644 mW/m$^2$ UV-A EIT (320 nm-390 nm); 1856 mW/m$^2$ UV-B EIT (280 nm-320 nm); 362 mW/m$^2$ UV-C EIT (245 nm-265 nm); 1873 mW/m$^2$ UV-V EIT (385 nm-440 nm) for the final curing in final curing station 30. The curing power, in W/m$^2$, is the UV radiation as measured with an EIT PowerPuck II.

An advantage of the printing method in accordance with the invention is that, as opposed to the wet on semi-dry printing method, no adjusting of the ink and of the ink properties is required.

TABLE 10

| | Invention LED pin curing | Invention Hg lamp pin curing | No pin curing | Wet-on-wet | Wet on semi-dry |
|---|---|---|---|---|---|
| Side Shooters | −− | −−− | + | + | − |
| Failing Nozzles | −− | −− | + | − | −− |
| Mottle | + | −− | −−− | + | ++ |
| Gloss Differences | + | ++ | −−− | −−− | + |
| Intercolor Bleeding | − | −− | −−− | −−− | + |
| Strikethrough | NA | NA | NA | NA | NA |
| Sharpness, microscope | − | ++ | −−− | + | + |

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An inkjet printing device for single pass printing on a surface of an ink-receiver, the inkjet printing device comprising:

a plurality of sets of nozzles arranged to jet N inks on the surface, wherein N is larger than or equal to one, the N inks include a first ink, and the plurality of sets of nozzles includes a first set of nozzles and a second set of nozzles arranged to jet the first ink;

a radiation curing device arranged to cure the first ink after the first ink has been jetted on the surface by the first set of nozzles, the radiation curing device being positioned between the first set of nozzles and the second set of nozzles; and a final curing device arranged to cure the N inks after the N inks have been jetted on the surface by the first set of nozzles and the second set of nozzles; wherein the radiation curing device is configured to pin cure the first ink after the first ink has been jetted on the surface by the first of set of nozzles.

2. The inkjet printing device according to claim 1, wherein the radiation curing device is stationary in the inkjet printing device; and the inkjet printing device further comprises a transporting device arranged to move the ink-receiver with respect to the radiation curing device.

3. The inkjet printing device according to claim 1, wherein the first set of nozzles is arranged to print a first sub-image on the surface, and the second set of nozzles is arranged to print a second sub-image on the surface; and the second set of nozzles is positioned in a staggered pattern with respect to the first set of nozzles such that the first sub-image and the second sub-image are mutually interstitial.

4. The inkjet printing device according to claim 1, wherein N equals four and the plurality of sets of nozzles includes eight sets of nozzles, the first ink is a black ink, the N inks further including a cyan ink, a magenta ink, and a yellow ink;

the eight sets of nozzles includes the first set of nozzles and the second set of nozzles arranged to jet the black ink, a third set of nozzles and a fourth set of nozzles arranged to jet the cyan ink, a fifth set of nozzles and a sixth set of nozzles arranged to jet the magenta ink, and a seventh set of nozzles and an eighth set of nozzles arranged to jet the yellow ink;

the radiation curing device is positioned between the first set of nozzles, the third set of nozzles, the fifth set of nozzles, and the seventh set of nozzles that are upstream of the radiation curing device and the second set of nozzles, the fourth set of nozzles, the sixth set of nozzles ink, and the eighth set of nozzles that are downstream of the radiation curing device.

5. The inkjet printing device according to claim 1, wherein the plurality of sets of nozzles includes, for each of the N inks, two sets of nozzles, three sets of nozzles, or four sets of nozzles.

6. The inkjet printing device according to claim 1, further comprising a piezoelectric print head configured to jet ink drops having drop sizes through the plurality of sets of nozzles, wherein each set of nozzles of the plurality of sets of nozzles has a resolution and a jetting frequency, and the piezoelectric print head is configured to control the ink drop sizes and the jetting frequencies of each set of nozzles to jet an image on the surface of the ink-receiver, at full coverage of the surface, with less than 6 g/m$^2$ of ink.

7. The inkjet printing device according to claim 1, further comprising:

a second radiation curing device arranged to cure the first ink after the first ink has been jetted on the surface by the second set of nozzles, wherein the second radiation curing device is positioned between the second set of nozzles and the final curing device; wherein the second radiation curing device is configured to pin cure the first ink after the first ink has been jetted on the surface by the second set of nozzles.

8. The inkjet printing device according to claim 1, wherein the first set of nozzles is configured to print a different ink drop size than the second set of nozzles.

9. A single pass inkjet printing method comprising the steps of:

jetting N inks on a surface of an ink-receiver, wherein N is larger than or equal to one;

jetting a first portion of a first ink of the N inks on the surface by a first set of nozzles;

radiation curing the first portion of the first ink jetted on the surface;

jetting a second portion of the first ink on the surface by a second set of nozzles after the radiation curing of the first portion of the first ink; and final curing the N inks jetted on the surface; wherein the radiation curing of the first portion of the first ink jetted on the surface includes pin curing the first portion of the first ink.

10. The method according to claim 9, further comprising the step of:

pin curing the second portion of the first ink jetted on the surface.

11. The method according to claim 9, wherein the radiation curing step is performed by a radiation curing device, the method further comprising the steps of:

holding the radiation curing device stationary; and moving the ink-receiver with respect to the radiation curing device.

12. The method according to claim 9, further comprising the steps of:

jetting a first portion of a second ink of the N inks on the surface, wherein the second ink is different from the first ink;

radiation curing the first portion of the first ink jetted on the surface and the first portion of the second ink jetted on the surface; and jetting a second portion of the second ink on the surface after the radiation curing the first portion of the first ink and the first portion of the second ink.

13. The method according to claim 9, further comprising the steps of:

jetting a first set of ink drops through the first set of nozzles defining a first sub-image on the surface; and jetting a second set of ink drops through the second set of nozzles defining a second sub-image on the surface; wherein the second set of ink drops is jetted in a staggered pattern with respect to the first set of ink drops such that the first sub-image and the second sub-image are mutually interstitial.

14. The method according to claim 9, further comprising the steps of:

jetting sets of ink drops through a plurality of sets of nozzles on the surface at a set of resolutions and at jetting frequencies, the sets of ink drops having ink drop sizes, each set of ink drops of the sets of ink drops being jetted through a specific set of nozzles of the plurality of sets of nozzles, at a specific resolution, and at a specific jetting frequency; and adapting the set of resolutions, the jetting frequencies, and the ink drop sizes such that an image is jetted on the surface of the ink-receiver, at full coverage of the surface, with less than 6 g/m$^2$ of ink.

15. The method according to claim 9, wherein the first set of nozzles is configured to print a different ink drop size than the second set of nozzles.

* * * * *